US008079098B2

(12) United States Patent
Thomas

(10) Patent No.: US 8,079,098 B2
(45) Date of Patent: Dec. 20, 2011

(54) PULL ROD COUPLING

(75) Inventor: Kurt Judson Thomas, Indianapolis, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 1794 days.

(21) Appl. No.: 10/928,357

(22) Filed: Aug. 27, 2004

(65) Prior Publication Data

US 2006/0042006 A1 Mar. 2, 2006

(51) Int. Cl.
*E03C 1/04* (2006.01)

(52) U.S. Cl. ..... 4/678; 4/675; 4/689; 4/693; 4/695; 4/677; 137/801

(58) Field of Classification Search ..... 4/675, 678, 4/695, 696, 677, 684, 689–693; 137/119.3–119.5, 137/359, 801
See application file for complete search history.

(56) References Cited

U.S. PATENT DOCUMENTS

| | | | | |
|---|---|---|---|---|
| 1,654,550 | A * | 1/1928 | Muend | 137/359 |
| 4,218,785 | A | 8/1980 | Crawford et al. | |
| 4,698,858 | A * | 10/1987 | Kostorz | 4/677 |
| 5,845,670 | A * | 12/1998 | Life | 137/119.05 |
| 5,924,451 | A | 7/1999 | Kuo | |
| 6,363,961 | B1 | 4/2002 | Wang | |
| 6,668,393 | B1 * | 12/2003 | Mascari et al. | 4/678 |
| 6,725,472 | B2 | 4/2004 | Gray et al. | |

* cited by examiner

*Primary Examiner* — Tuan Nguyen
(74) *Attorney, Agent, or Firm* — Baker & Daniels LLP

(57) ABSTRACT

A pull rod coupling configured to operably couple a pull rod to a fluid control device.

14 Claims, 7 Drawing Sheets

PULL ROD COUPLING

BACKGROUND AND SUMMARY OF THE INVENTION

The present invention relates to a pull or lift rod coupling operably connected to a fluid control device. More particularly, the present invention relates to a pull rod coupling for use with a faucet assembly.

It is well known to provide pull or lift rods in combination with fluid control devices. For example, conventional shower faucet assemblies often include a pull rod operably coupled to a diverter valve assembly which directs the flow of water through either a delivery spout or a shower head. Similarly, conventional faucet assemblies mounted to a sink deck often have a pull rod which is configured to raise and lower a pop-up drain plug. Typically, a coupling operably connects the pull rod to the fluid control device, for example, the diverter valve assembly or the pop-up drain plug.

There is a need for a pull rod coupling which facilitates installation by not requiring direct access to the coupling, thereby preventing unsightly openings in the faucet assembly and unusual installation methods. In addition, there is a need for a pull rod coupling which will not inadvertently disconnect the pull rod from the fluid control device in normal operation while still permitting easy removal for service, without significant knowledge of the faucet assembly structure. Further, given that pull rods may often be of a long length, angular misalignment during installation is a concern. As such, it is desired to have a pull rod coupling which will permit for certain angular variations and prevent binding of the pull rod. Finally, pull rods often have a decorative handle or finial at the upper end thereof. Often it is desirable to have this finial sit flush on its mating surface of the faucet assembly for aesthetic purposes. Tolerance issues with an axially rigid pull rod connection often prevent this from being possible. As such, there is a need for a pull rod coupling which provides for a limited amount of axial play, thereby allowing the finial to sit flush with its mating surface on the faucet assembly, regardless of tolerance variations in total length of the coupled assembly.

According to an illustrative embodiment of the present invention, a faucet assembly includes a pull rod having a longitudinal axis, a first end, and a second end. A coupling operably connects the second end of the pull rod to a fluid control device, the coupling including a male portion supported by the second end of the pull rod and having a threaded section with a plurality of external threads, and a female portion having a threaded section with a plurality of internal threads and a socket positioned axially adjacent the threaded section. The male portion is movable from a first mode where the external threads are threadably coupled with the internal threads of the female portion, to a second mode where the external threads are uncoupled from the internal threads and received within the socket. The male portion is rotatable relative to the female portion about the longitudinal axis and is independently movable along the longitudinal axis within the socket when the male portion of the coupling is in the second mode.

Further illustratively, the male portion is pivotable relative to the female portion about an axis extending perpendicular to the longitudinal axis when the male portion of the coupling is in the second mode.

Illustratively, the faucet assembly further comprises a delivery spout, and a handle supported on the first end of the pull rod. The pull rod further illustratively extends through a portion of the delivery spout.

In an illustrative embodiment, the fluid control device comprises a diverter valve assembly configured to control the flow of water to the delivery spout. In a further illustrative embodiment, the fluid control device comprises a drain assembly including a plug movable in response to movement of the pull rod.

In a further illustrative embodiment of the present invention, a pull rod coupling includes a male portion having a connecting section with a longitudinal axis and an outer diameter, and a threaded section positioned axially below the connecting section and having a plurality of external threads with a major diameter and an axial length. A female portion includes a socket having an inner diameter and an axial length, and a threaded section positioned axially above the socket. The threaded section includes a plurality of internal threads with a minor diameter and configured to threadably couple with the external threads of the male portion. The outer diameter of the connecting section is less than the minor diameter of the internal threads, while the major diameter of the external threads is less than the inner diameter of the socket. Further, the axial length of the external threads is less than the axial length of the socket.

Illustratively, in a first connecting mode, the external threads of the male portion threadably engage the internal threads of the female portion. Further, in a second connecting mode, the external threads of the male portion are fully received within the socket and the connecting section is concentrically received within the threaded section of the female portion.

According to another illustrative embodiment of the present invention, a faucet assembly includes a fluid control device, and a pull rod including a longitudinal axis, a first end, and a second end positioned below the first end. A coupling operably connects the second end of the pull rod to the fluid control device. The coupling provides for rotation of the pull rod relative to the fluid control device about the longitudinal axis, for movement of the pull rod relative to the fluid control device in an axial direction along the longitudinal axis, and for pivoting movement of the pull rod relative to the fluid control device about an axis extending perpendicular to the longitudinal axis.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

While in the following detailed description the present invention will be described for use with a faucet assembly by operably coupling to a diverter valve assembly or a pop-up drain assembly, it should be appreciated that the pull rod coupling is not limited to such applications. More particularly, the pull rod coupling of the present invention may be utilized with any conventional fluid control device.

Figure 1:
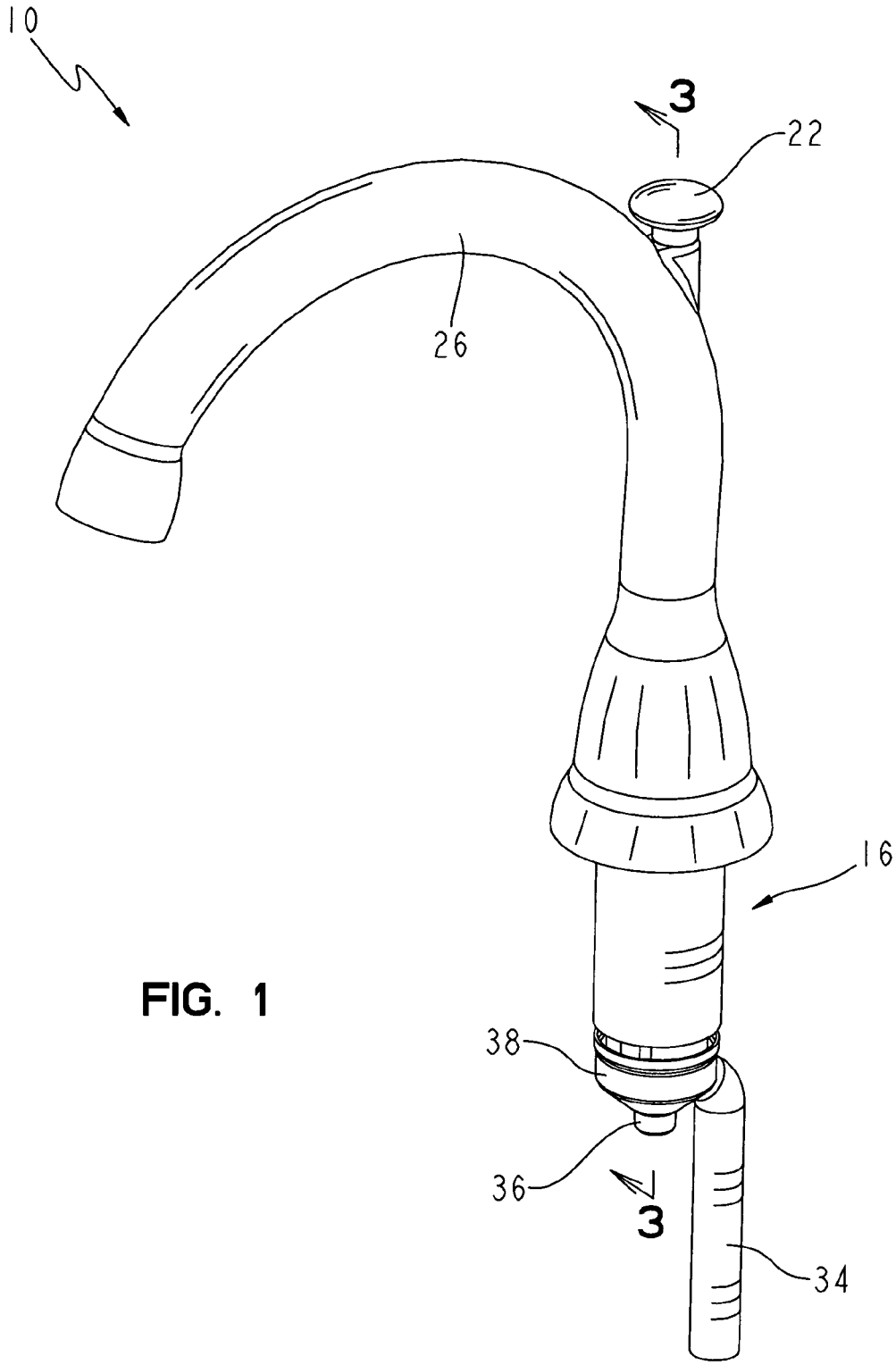
FIG. 1 is a perspective view of a faucet assembly including an illustrative embodiment pull rod coupling of the present invention.
Figure 2:
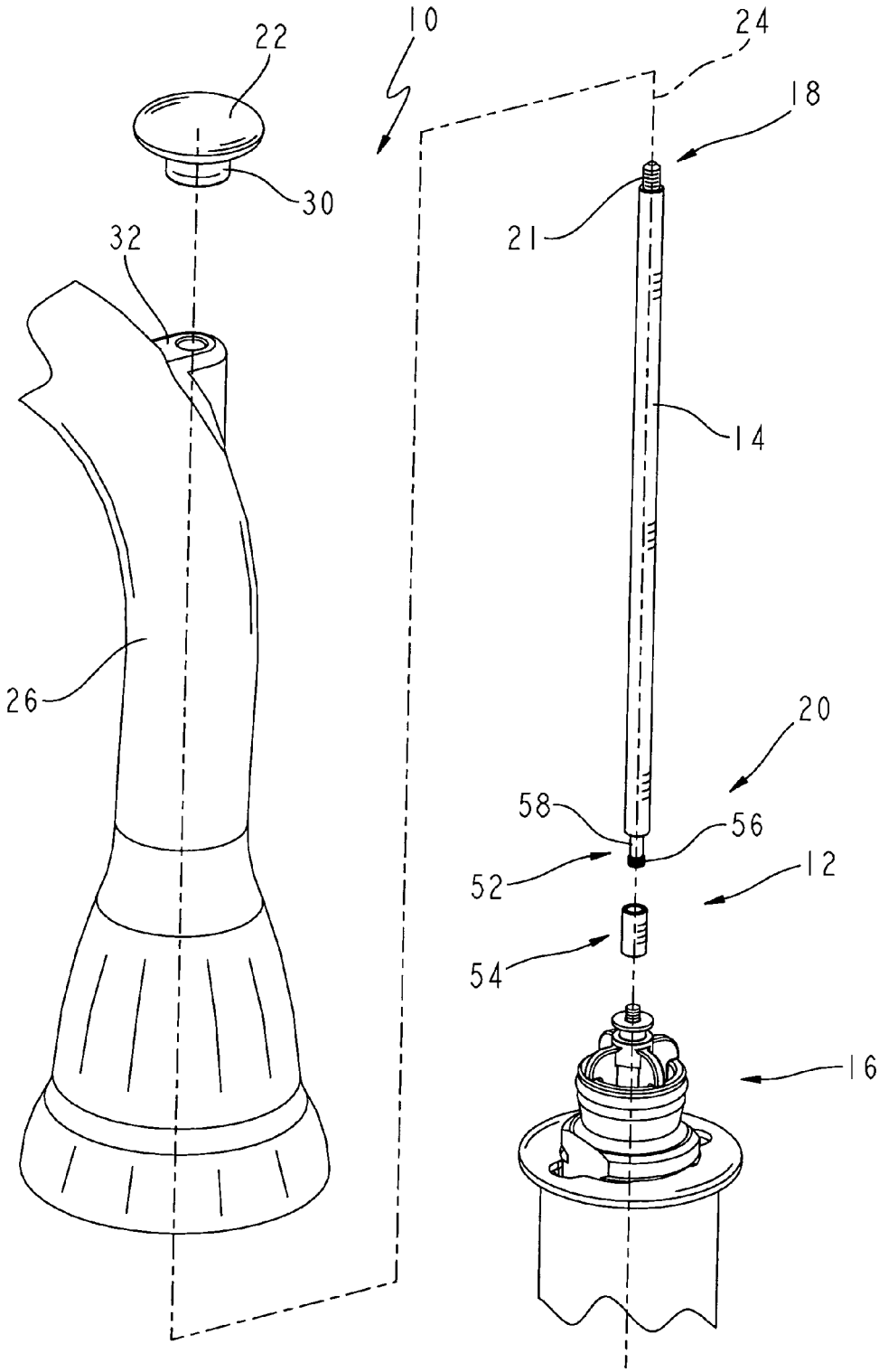
FIG. 2 is a partially exploded perspective view of the faucet assembly of FIG. 1.
Figure 3:
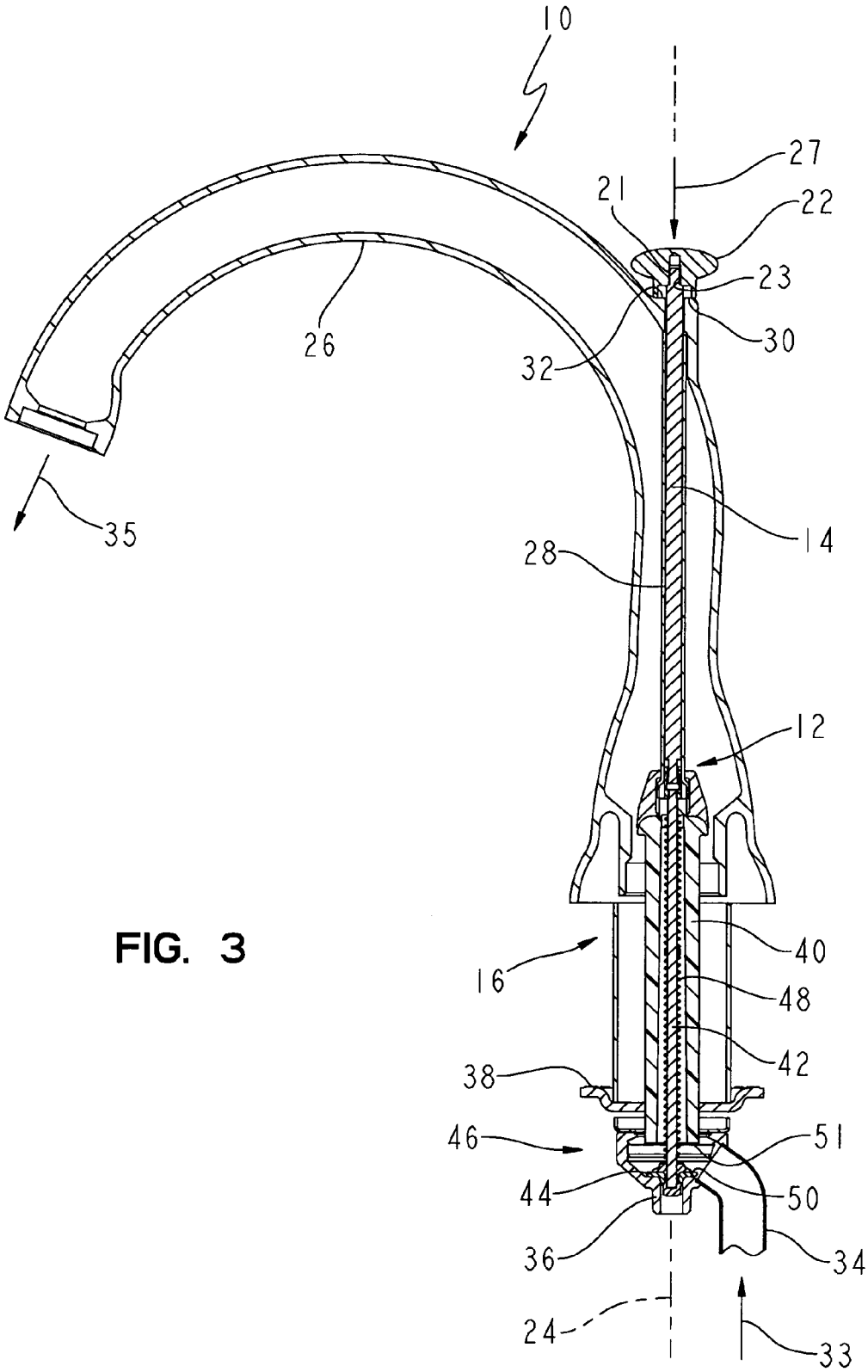
FIG. 3 is a cross-sectional view taken along line 3-3 of FIG. 1, illustrating the pull rod coupling operably connecting a pull rod to a diverter valve assembly, with the pull rod in a lowered position.

With reference initially to FIGS. 1 and 2, a faucet assembly 10 is shown as including an illustrative embodiment pull rod coupling 12 of the present invention. Illustratively, the pull rod coupling 12 operably connects a pull or lift rod 14 to a fluid control device, such as a diverter valve assembly 16. The pull rod 14 includes a first or upper end 18 and a lower or second end 20. Illustratively, the pull rod 14 is cylindrical and formed of a metal, such as brass. A handle 22, illustratively a knob or finial also formed of brass, is coupled to the first end 18 of the pull rod 14. More particularly, the first end 18 of the pull rod 14 includes a plurality of external threads 21 for engaging a plurality of internal threads 23 formed in the handle 22 (FIG. 3). The second end 20 of the pull rod 14 is connected to the coupling 12.

As shown in FIGS. 2-4 and 8, the pull rod 14 extends along a longitudinal axis 24 intersecting a curved portion of a delivery spout 26. As is known in the art, a pull rod guide 28 is supported within the delivery spout 26 and concentrically receives the pull rod 14 to guide its movement along the longitudinal axis 24. More particularly, the pull rod 14 is configured to move vertically within the pull rod guide 28 between a first, lowered position (FIG. 3) and a second, raised position (FIG. 4), as shown by arrows 27 and 29. As detailed below, in the lowered position of FIG. 3, a lower surface 30 of the handle 22 rests on a mating surface or seat 32 extending upwardly from the delivery spout 24, thereby eliminating any visible gap therebetween and providing an aesthetically pleasing appearance.

Figure 4:
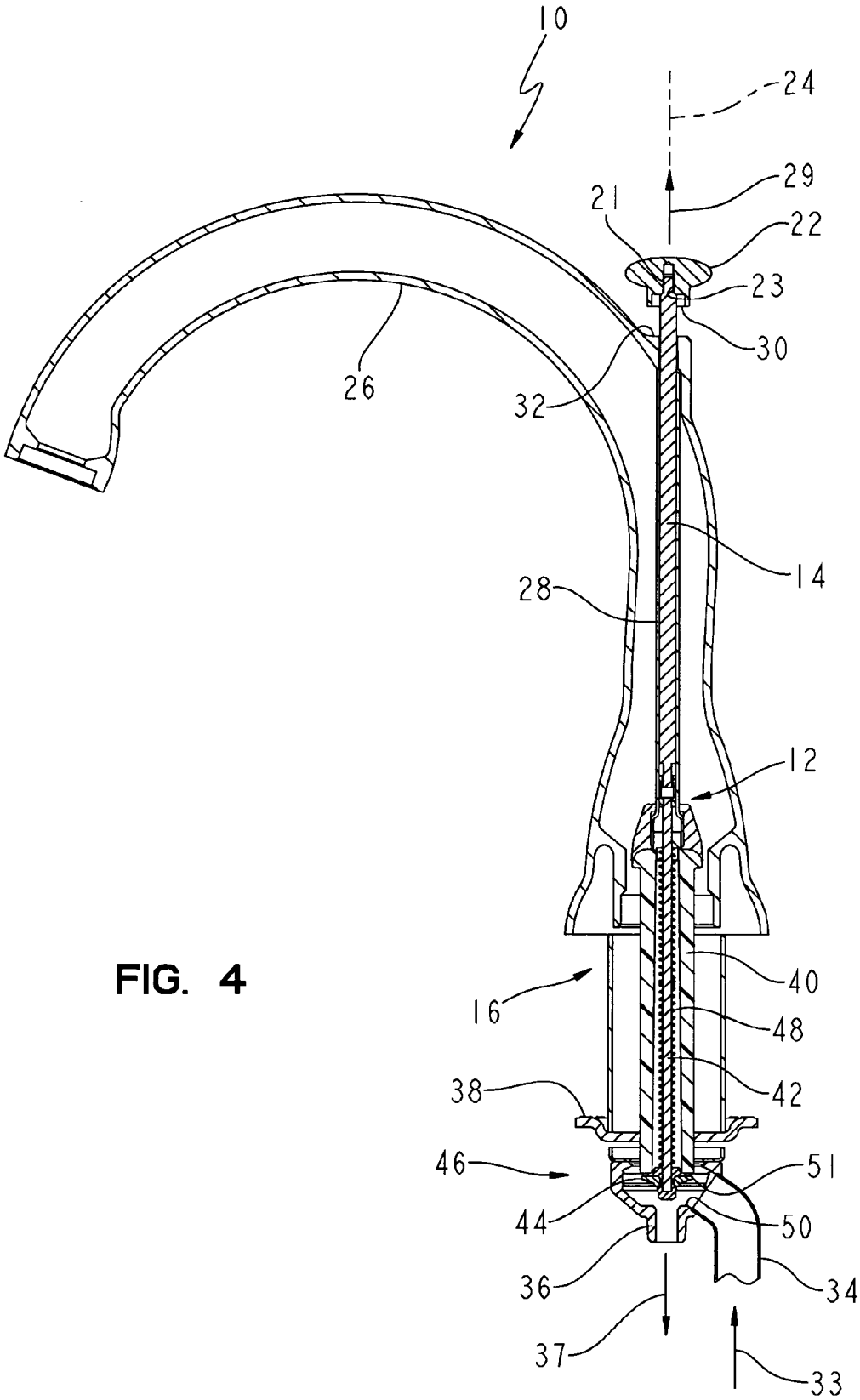
FIG. 4 is a cross-sectional view similar to FIG. 3, showing the pull rod in a raised position.

An inlet tube 34 is in fluid communication with the diverter valve assembly 16. As is known in the art, the diverter valve assembly 16 is movable from a first position where fluid flows in the direction of arrow 33 from the inlet tube 34 through the delivery spout 26 in the direction of arrow 35 (FIG. 3), to a second position where fluid flows in the direction of arrow 33 from the inlet tube 34 through a diverter outlet 36 in the direction of arrow 37 (FIG. 4). Typically the diverter outlet 36 is in fluid communication with a shower head (not shown).

The diverter valve assembly 16 is of conventional design and illustratively includes a body 38 which concentrically receives a diverter retainer 40. A diverter stem 42 is concentrically received within the retainer 40 and supports a seal or diaphragm 44 at its lower end 46. A spring 48 is concentrically received around the diverter stem 42 and biases the stem 42 and seal 44 downwardly for engagement with a valve seat 50 for sealing off the diverter outlet 36 from the inlet tube 34. As noted above, when the pull rod 14, and hence the stem 42, are in first or lowered positions as shown in FIG. 3, fluid flows through the inlet tube 34 through the diverter retainer 40 and the body 38 of the diverter valve assembly 16, and out through the delivery spout 26. When the pull rod 14 and stem 42 are in second or raised positions as shown in FIG. 4, the seal 44 is raised from the seat 50 and water pressure acts against the bias of the spring 48. The seal 44 engages a seat 51 for sealing off the delivery spout 26 from the inlet tube 34. As such, water flows through the inlet tube 34 and out through the diverter outlet 36.

With reference to FIGS. 5-8, the pull rod coupling 12 of the illustrative embodiment includes a male portion 52 and a cooperating female portion 54. The male portion 52 is supported by the second end 20 of the pull rod 14 and may be integrally formed therewith. The male portion 52 includes a lower threaded section 56 and an upper connecting section 58. Illustratively, the connecting section 58 comprises a cylindrical rod having an outer diameter 59. The threaded section 56 includes a plurality of external threads 60 having a major diameter 62 and an axial length 64.

The female portion 54 includes a socket 66 having an inner diameter 68 and an axial length 70. The female portion 54 further includes an upper threaded section 72 positioned axially above the socket 66 and having a plurality of internal threads 74 configured to threadably engage and couple with the external threads 60 of the male portion 52. The internal threads 74 have a minor diameter 76 and an axial length 78. The female portion 54 may also include a lower threaded section 79 positioned axially below the socket 66 and including a plurality of internal threads 74 substantially identical to those in the upper threaded section 72. The lower threaded section 79 facilitates coupling to the fluid control device, such as the diverter valve assembly 16.

Figure 7:
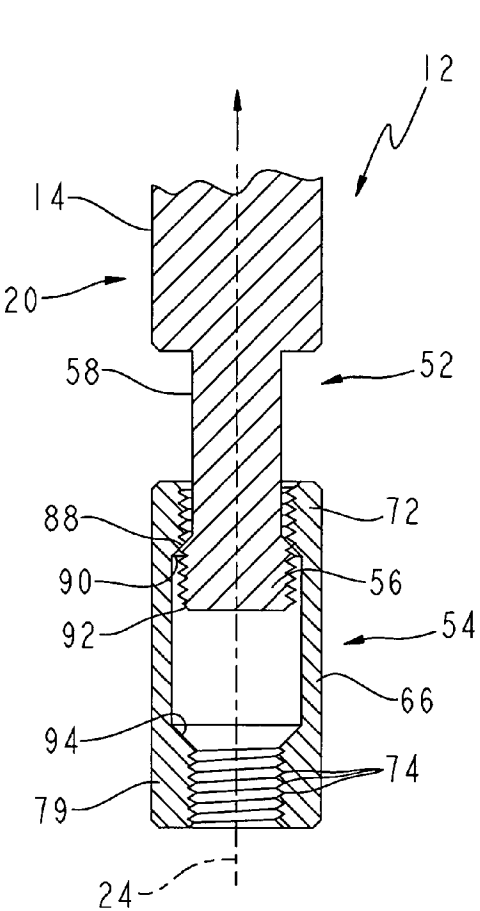
FIG. 7 is a cross-sectional view similar to FIG. 6, showing the pull rod being raised to lift the pull rod coupling.
Figure 6:
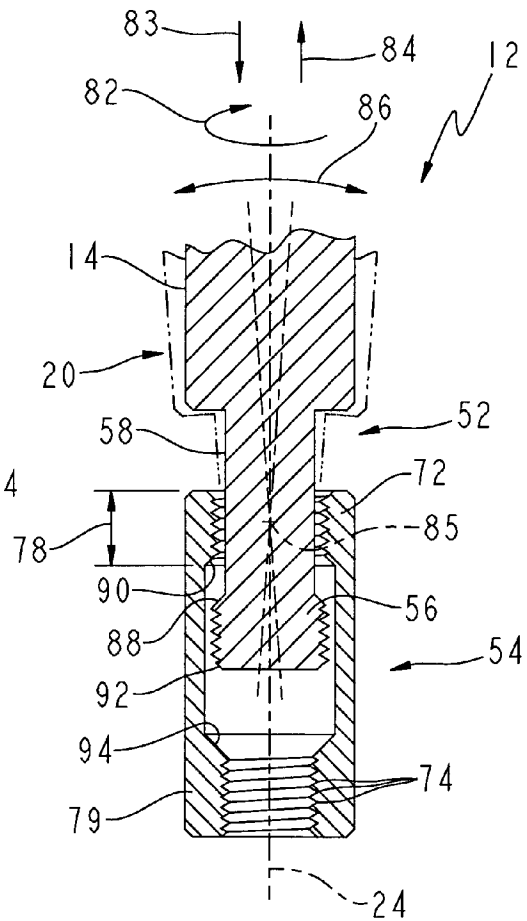
FIG. 6 is a cross-sectional view similar to FIG. 5, with the pull rod coupling in a second connecting mode illustrating the external threads of the male portion fully received within the socket of the female portion.
Figure 5:
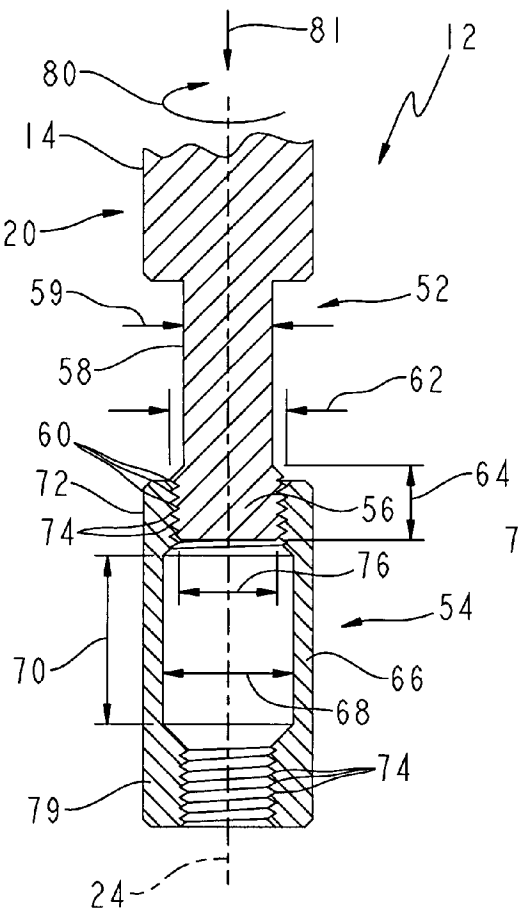
FIG. 5 is a cross-sectional view of the pull rod coupling of FIG. 2 in a first connecting mode illustrating the male portion threadably engaging the female portion.
Figure 8:
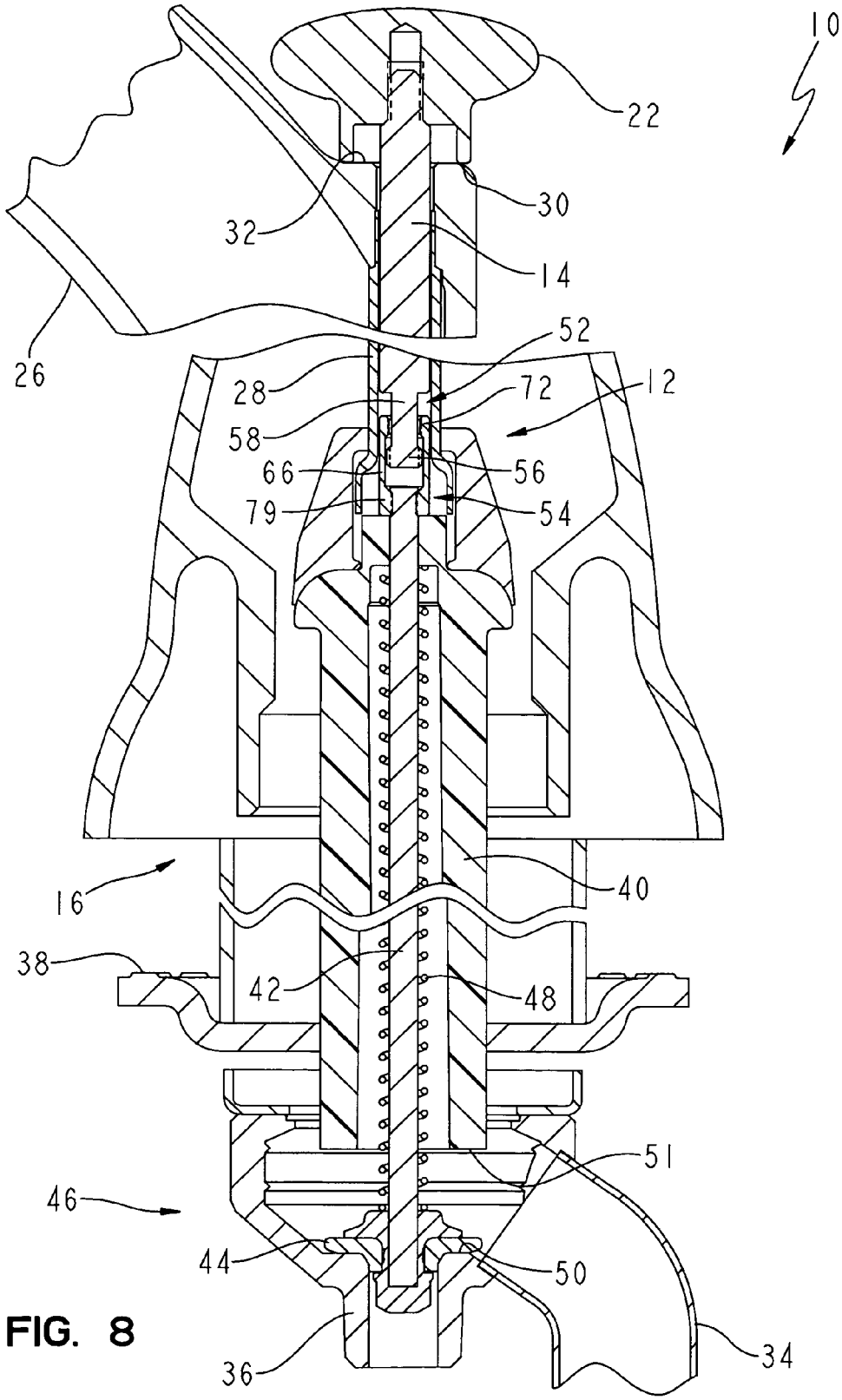
FIG. 8 is an enlarged cross-sectional view similar to that of FIG. 3.

The male portion 52 is movable from a first connecting mode shown in FIG. 5 where the external threads 60 threadably couple with the internal threads 74 of the female portion 54, to a second connecting mode shown in FIGS. 6 and 7 where the external threads 60 are fully received within the socket 66. More particularly, rotation of the male portion 52 about the longitudinal axis 24 in a clockwise direction, as shown by arrow 80 in FIG. 5, causes axial movement downward along the longitudinal axis 24, as shown by arrow 81. When the male portion 52 is in the second connecting mode, the pull rod 14 is rotatable about the longitudinal axis 24 (i.e. rotational freedom as shown by arrow 82 in FIG. 6) and is independently movable along the longitudinal axis 24 (axial play as shown by arrows 83 and 84 in FIG. 6). Further, the pull rod 14 is supported for pivoting movement about a transverse axis 85 extending perpendicular to the longitudinal axis 24 when the male portion 52 is in the second connecting mode (i.e. angular play as shown by arrow 86 in FIG. 6).

To facilitate rotational freedom and angular play of the pull rod 14, the outer diameter 59 of the connecting section 58 is less than the minor diameter 76 of the internal threads 74, and the major diameter 62 of the external threads 60 is less than the inner diameter 68 of the socket 66. Further, to facilitate axial play of the pull rod 14, the axial length 64 of the external threads 60 is less than the axial length 70 of the socket 66. More particularly, since the connecting section 58 has an outer diameter 59 less than the minor diameter 76 of the internal threads 74, axial movement is permitted between the connecting section 58 and the internal threads 74. Similarly, since the inner diameter 68 of the socket 66 is greater than the major diameter 62 of the external threads 60, axial movement is permitted between the external threads 60 and the socket 66.

A first stop surface 88 is supported by the male portion 52 and is configured to contact a downwardly facing surface 90 of the female portion 54 to limit axial movement of the male portion 52 relative to the female portion 54 upwardly in the direction of arrow 82 in FIGS. 6 and 7. A second stop surface 92 is supported by the male portion 52 and is configured to contact an upwardly facing surface 94 of the socket 66 to limit axial movement of the male portion 52 relative to the female portion 54 downwardly in the direction of arrow 84 in FIG. 6.

Figure 9:
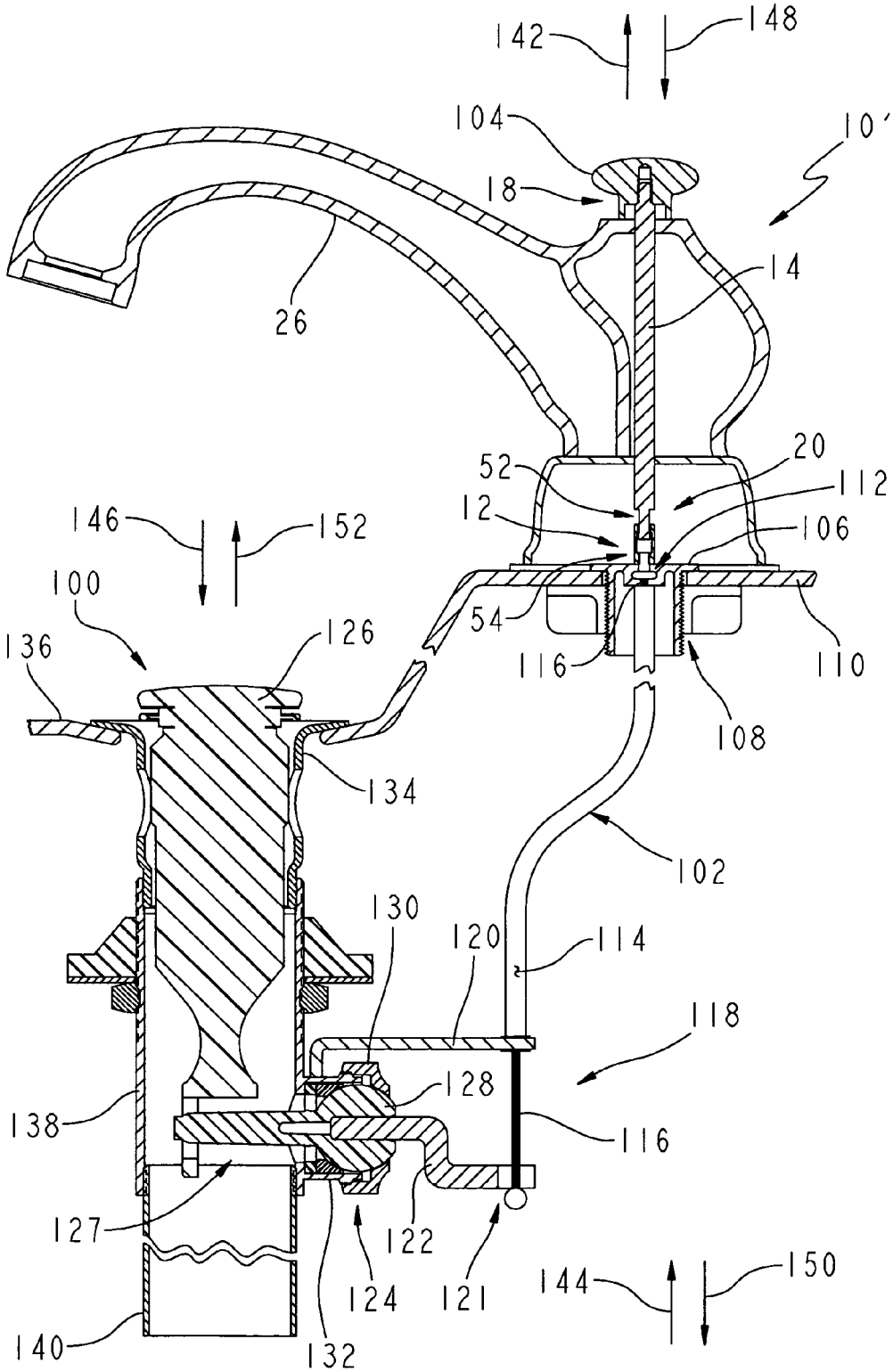
FIG. 9 is a cross-sectional view illustrating application of an illustrative embodiment pull rod coupling to a pop-up drain assembly.

FIG. 9 shows the application of the illustrative embodiment pull rod coupling 12 in connection with a pop-up drain assembly 100. In the following description like reference numbers are used to identify elements substantially the same as those detailed above in connection with FIGS. 1-8.

The pull rod coupling 12 in FIG. 9 operably couples the pull rod 14 to the actuator cable 102 of the drain assembly 100. More particularly, a handle 104 is coupled to the first end 18 of the pull rod 14, while the male portion 52 of the coupling 12 is connected to the second end 20 of the pull rod 14. Illustratively, the pull rod coupling 12 is positioned above a retaining ring 106 threadably received within an opening 108 formed within the sink deck 110.

A first or upper end 112 of the actuator cable 102 is supported by the retaining ring 106. More particularly, the actuator cable 102 includes an outer sheath 114 receiving an inner wire 116 for sliding movement therein. At the first end 112, the outer sheath 114 is fixed to the retaining ring 106 while the inner wire 116 is coupled to the female portion 54 of the pull rod coupling 12. At a second or lower end 118 of the actuator cable 102, the outer sheath 114 is fixed to a retaining bracket 120 and the inner wire 116 is coupled to the first end 121 of a pivot arm 122.

The pivot arm 122 is configured to pivot about a pivot seat 124 in order to raise and lower a stopper or plug 126 coupled to the second end 127 of the pivot arm 122. More particularly, the pivot seat 124 includes a truncated ball 128 supported for pivoting movement within a pivot nut 130 and cooperating pivot seat 132. The plug 126 is received within a flange 134 supported by the sink basin 136. The flange 134 is in fluid communication with a tubular drain body 138 which is in fluid communication with a tailpiece 140 for coupling to a conventional drain pipe (not shown).

In operation, pulling up on the handle 104 lifts the pull rod 14 in the direction of arrow 142. In response, the pull rod coupling 12 causes the inner wire 116 of the actuator cable 102 and, in turn, the first end 121 of the pivot arm 122 to move upwardly in the direction of arrow 144. The pivot arm 122 pivots about the pivot seat 124, thereby causing downward movement of the plug 126 in the direction of arrow 146. Pushing down on the raised handle 104 lowers the pull rod 14 in the direction of arrow 148. In response the pull rod coupling 12 causes the inner wire 116 of the actuator cable 102 and, in turn, the first end 121 of the pivot arm 122 to move downwardly in the direction of arrow 150. The pivot arm 122 pivots about the pivot seat 124, thereby causes upward movement of the plug 126 in the direction of arrow 152.

Although the invention has been described in detail with reference to certain preferred embodiments, variations and modifications exist within the spirit and scope of the invention as described and defined in the following claims.

The invention claimed is:

1. A faucet assembly comprising:

a pull rod including a longitudinal axis, a proximal end, and a distal end;

a fluid control device;

a coupling operably connecting the distal end of the pull rod to the fluid control device, the coupling including a male portion supported by the distal end of the pull rod and having a male threaded section with a plurality of external threads, a female portion having a female threaded section with a plurality of internal threads and a socket positioned axially adjacent and distal to the female threaded section, the male portion being movable from a first mode where the external threads are threadably coupled with the internal threads of the female portion, to a second mode where the external threads are uncoupled from the internal threads and received within the socket;

the male portion further includes a connecting section connecting the male threaded section to the distal end of the pull rod, the connecting section being positioned proximal to the male threaded section and having an outer lateral dimension less than the minor diameter of the internal threads of the female portion, such that the male portion is rotatable relative to the female portion about the longitudinal axis and independently movable along the longitudinal axis within the socket when the male portion of the coupling is in the second mode; and a stop surface supported by the male portion and configured to contact an internal surface of the socket to limit axial movement of the male portion upwardly relative to the female portion when the male portion of the coupling is in the second mode.

2. The faucet assembly of claim 1, wherein the male portion is pivotable relative to the female portion about an axis extending perpendicular to the longitudinal axis when the male portion of the coupling is in the second mode.

3. The faucet assembly of claim 1, wherein the socket includes an inner diameter greater than the major diameter of the external threads of the male portion, thereby permitting axial movement between the external threads and the socket when the male portion is in the second mode.

4. The faucet assembly of claim 1, further comprising a delivery spout, and a handle supported on the first end of the pull rod, wherein the pull rod extends through a portion of the delivery spout.

5. The faucet assembly of claim 4, wherein the fluid control device comprises a diverter valve assembly configured to control the flow of water to the delivery spout.

6. The faucet assembly of claim 1, wherein the fluid control device comprises a drain assembly including a plug movable in response to movement of the pull rod.

7. A faucet assembly comprising:

a fluid control device;

a pull rod including a longitudinal axis, a first end, and a second end positioned below the first end; and a coupling operably connecting the second end of the pull rod to the fluid control device, the coupling providing for at least three degrees of freedom relative to the fluid control device including rotation of the pull rod relative to the fluid control device about the longitudinal axis, movement of the pull rod relative to the fluid control device in an axial direction along the longitudinal axis independent of rotation of the pull rod, and pivoting movement of the pull rod relative to the fluid control device about an axis extending perpendicular to the longitudinal axis.

8. The faucet assembly of claim 7, wherein the coupling comprises:

a male portion supported by the second end of the pull rod and including a threaded section with a plurality of external threads;

a female portion including a threaded section with a plurality of internal threads and a socket positioned axially below the threaded section, the male portion being movable from a first connecting mode where the external threads threadably engage the internal threads of the female portion, to a second connecting mode where the external threads are fully received within the socket; and wherein the male portion is rotatable relative to the female portion about the longitudinal axis and independently movable along the longitudinal axis within the socket when the male portion of the coupling is in the second connecting mode.

9. The faucet assembly of claim 8, wherein the male portion further includes a connecting section connecting the external threads to the second end of the pull rod, the connecting section having an outer diameter less than the minor diameter of the internal threads of the female portion, thereby permitting axial movement between the connecting section and the internal threads.

10. The faucet assembly of claim 9, wherein the socket includes an inner diameter greater than the major diameter of the external threads of the male portion, thereby permitting axial movement between the external threads and the socket.

11. The faucet assembly of claim 10, further comprising a stop surface supported by the male portion and configured to contact an internal surface of the socket to limit axial movement of the male portion relative to the female portion.

12. The faucet assembly of claim 7, wherein the fluid control device comprises a diverter valve assembly configured to control the flow of water in response to movement of the pull rod.

13. The faucet assembly of claim 7, wherein the fluid control device comprises a drain assembly including a plug movable in response to movement of the pull rod.

14. The faucet assembly of claim 1, wherein the connecting section steps radially inwardly from, and proximal to, the male threaded section.

* * * * *